US008564496B2

(12) United States Patent
Chen

(10) Patent No.: US 8,564,496 B2
(45) Date of Patent: Oct. 22, 2013

(54) BROADBAND ANTENNA

(75) Inventor: Yen-Cheng Chen, Hsinchu County (TW)

(73) Assignee: Wistron NeWeb Corp., Hsinchu County (TW)

( * ) Notice: Subject to any disclaimer, the term of this patent is extended or adjusted under 35 U.S.C. 154(b) by 187 days.

(21) Appl. No.: 12/985,141

(22) Filed: Jan. 5, 2011

(65) Prior Publication Data

US 2012/0032866 A1 Feb. 9, 2012

(30) Foreign Application Priority Data

Aug. 4, 2010 (TW) ..... 99214904 U

(51) Int. Cl.
*H01Q 1/48* (2006.01)
*H01Q 1/36* (2006.01)

(52) U.S. Cl.
USPC ..... 343/846; 343/906; 343/700 MS

(58) Field of Classification Search
USPC ..... 343/846, 906, 700 MS, 702
See application file for complete search history.

(56) References Cited

U.S. PATENT DOCUMENTS

| | | | | |
|---|---|---|---|---|
| 7,218,282 | B2 * | 5/2007 | Humpfer et al. | 343/700 MS |
| 7,705,788 | B2 * | 4/2010 | Hung et al. | 343/702 |
| 2009/0262026 | A1 * | 10/2009 | Yu et al. | 343/700 MS |
| 2010/0201578 | A1 * | 8/2010 | Parsche | 343/700 MS |

* cited by examiner

*Primary Examiner* — Jacob Y Choi
*Assistant Examiner* — Amal Patel
(74) *Attorney, Agent, or Firm* — Merchant & Gould P.C.

(57) ABSTRACT

A broadband antenna includes a substrate having a first surface on which a first radiator arm, a second radiator arm, a first connecting conductor and a first grounding section are disposed, and a second surface on which a second connecting conductor and a second grounding section are disposed. The first connecting conductor has one end connected to a junction at which the first and second radiator arms are interconnected, and has another end connected to the first grounding section. The first connecting conductor has a feed-in point disposed thereon. The second connecting conductor has one end connected to the second grounding section. Moreover, at least a portion of the first connecting conductor overlaps with a projection of the second connecting conductor onto the first surface so that transmission directions of signals in the first and second connecting conductors are the same.

5 Claims, 12 Drawing Sheets

BROADBAND ANTENNA

CROSS-REFERENCE TO RELATED APPLICATION

This application claims priority of Taiwanese Application No. 099214904, filed on Aug. 4, 2010.

BACKGROUND OF THE INVENTION

1. Field of the Invention

The present invention relates to an antenna, more particularly to a broadband antenna.

2. Description of the Related Art

Applications of wireless local area networks (WLAN) are getting more and more extensive along with the development of wireless communication technology. Thus, antenna performance has become a key factor affecting value of products.

Communication devices today need to be built light and compact for complying with the market trend and user needs. However, due to limited space, bandwidth of a conventional planar inverted-F antenna is constrained from being able to meet the requirement of a broadband communication system, and transmission efficiency of the antenna is reduced.

SUMMARY OF THE INVENTION

Therefore, an object of the present invention is to provide a broadband antenna with high transmission efficiency and bandwidth in a limited space.

Accordingly, a broadband antenna of the present invention includes a substrate, a first radiator arm, a second radiator arm, a first grounding section, a first connecting conductor, a second grounding section, and a second connecting conductor.

The substrate has a first surface, and a second surface opposite to the first surface. The first radiator arm, the second radiator arm, the first grounding section, and the first connecting conductor are disposed on the first surface. The second radiator arm has an end connected to one end of the first radiator arm. The first connecting conductor has one end connected to a junction of the first radiator arm and the second radiator arm, and has another end connected to the first grounding section. The first connecting conductor has a feed-in point disposed thereon. The second grounding section and the second connecting conductor are disposed on the second surface. The second connecting conductor has one end connected to the second grounding section, and at least a portion of the second connecting conductor overlaps with a projection of the first connecting conductor onto the second surface. In this way, the transmission direction of radio frequency signals in the first connecting conductor is the same as the transmission direction in the second connecting conductor, and radiation patterns will have an additive effect such that the transmission efficiency and the bandwidth of the broadband antenna are increased.

Preferably, the first radiator arm, the second radiator arm and the first grounding section are substantially parallel with each other. The first grounding section is disposed at one side of the first surface. The first radiator arm and the second radiator arm are disposed at another side of the first surface opposite to the first grounding section.

Preferably, the broadband antenna further includes a coupling conductor disposed on the second surface. The second connecting conductor has another end connected to the coupling conductor, and at least a portion of the coupling conductor overlaps with a projection of the first and second radiator arms onto the second surface.

Preferably, the substrate further includes a conductive via formed through the first surface and the second surface for connecting the coupling conductor to the first connecting conductor, the first radiator arm, and the second radiator arm.

BRIEF DESCRIPTION OF THE DRAWINGS

Other features and advantages of the present invention will become apparent in the following detailed description of the five preferred embodiments with reference to the accompanying drawings, of which.

DETAILED DESCRIPTION OF THE PREFERRED EMBODIMENTS

Figure 1:
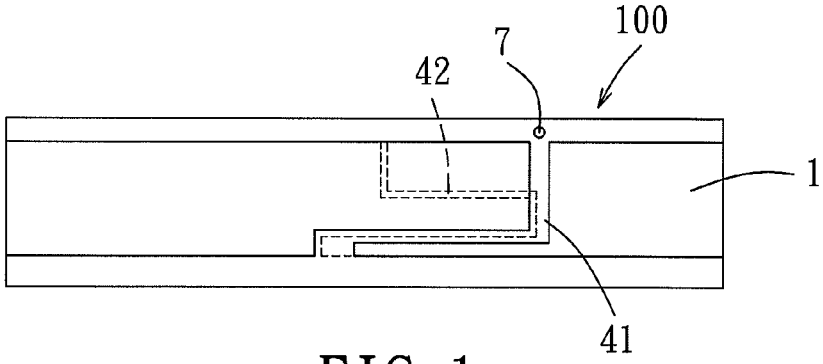
FIG. 1 illustrates a first preferred embodiment of a broadband antenna of the present invention.

Before the present invention is described in greater detail with reference to the preferred embodiments, it should be noted that the same reference numerals are used to denote the same elements throughout the following description.

Referring to FIG. 1, a first preferred embodiment of the broadband antenna 100 of the present invention includes a substrate 1 and a first conductor circuit and a second conductor circuit, each of which is disposed on a respective one of two surfaces of the substrate 1. Current directions in the first conductor circuit and the second conductor circuit are the same for increasing bandwidth and efficiency of the broadband antenna 100 by means of coupling the first conductor circuit and the second conductor circuit with each other.

Figure 2:
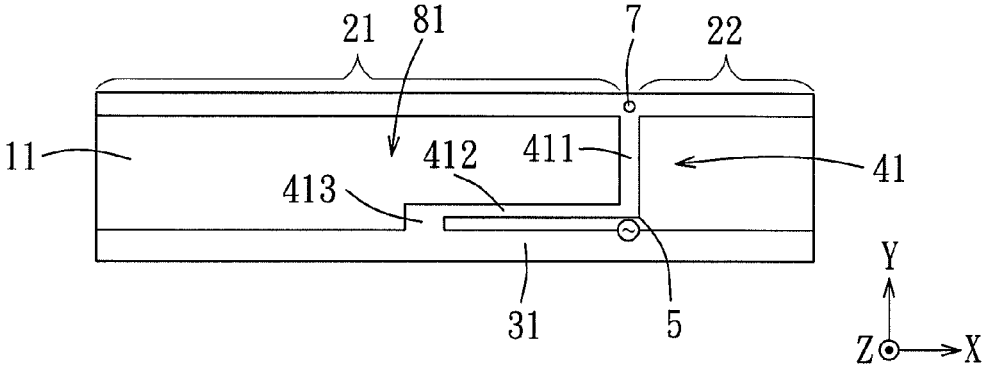
FIG. 2 illustrates a first conductor circuit on a first surface of a substrate of the first preferred embodiment.
Figure 3:
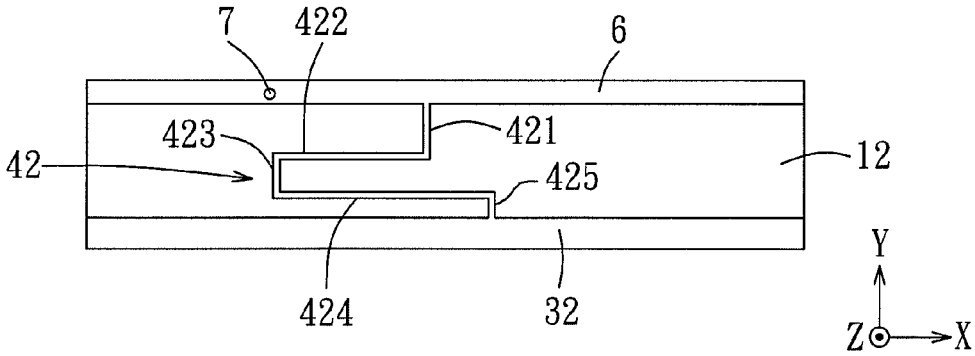
FIG. 3 illustrates a second conductor circuit on a second surface of the substrate of the first preferred embodiment.

Referring to FIG. 2 and FIG. 3, the substrate 1 is a rectangular circuit board having a first surface 11 on which the first conductor circuit is disposed, and a second surface 12 opposite to the first surface 11 and on which the second conductor circuit is disposed. In this embodiment, the first conductor circuit includes a first radiator arm 21, a second radiator arm 22, a first grounding section 31, and a first connecting conductor 41. The first radiator arm 21 has an end connected to one end of the second radiator arm 22. The first grounding section 31 is disposed at one long side of the first surface 11. The first radiator arm 21 and the second radiator arm 22 are disposed at another long side of the first surface 11 opposite to the first grounding section 31. The first grounding section 31 has a length equal to that of the long side, and the first grounding section 31, the first radiator arm 21 and the second radiator arm 22 are substantially parallel with each other.

The first connecting conductor 41 includes a first connecting section 411, a second connecting section 412, and a third connecting section 413. The second connecting section 412 has two ends, each of which is connected respectively to one end of the first connecting section 411 and one end of the third connecting section 413. The first connecting section 411 has another end connected to a junction of the first radiator arm 21 and the second radiator arm 22. The third connecting section 413 has another end connected to the first grounding section 31. The second connecting section 412 and the third connecting section 413 are disposed in a region 81 between the first radiator arm 21 and the first grounding section 31. The second connecting section 412 extends in a X-axis direction, and the first connecting section 411 and the third connecting section 413 extend in a Y-axis direction. The X-axis direction is perpendicular to the Y-axis direction. A junction of the first connecting section 411 and the second connecting section 412 is a feed-in point 5 of the antenna 100.

The second conductor circuit includes a coupling conductor 6, a second grounding section 32, and a second connecting conductor 42. The first grounding section 31 is disposed at one long side of the first surface 11, and the second grounding section 32 is disposed along one long side of the second surface 12 that corresponds to said one long side of the first surface 11. The first radiator arm 21 and the second radiator arm 22 are disposed at another long side of the first surface 11 opposite to the first grounding section 31, and the coupling conductor 6 is disposed along one long side of the second surface 12 that corresponds to said another long side of the first surface 11. The length of the second grounding section 32 is equal to that of the long side of the substrate 1, and is equal to the length of the first grounding section 31.

The second connecting conductor 42 includes a first connecting segment 421, a second connecting segment 422, a third connecting segment 423, a fourth connecting segment 424, and a fifth connecting segment 425, which are interconnected in series. The first connecting segment 421 has one end opposite to the second connecting segment 422 and connected to the coupling conductor 6. The fifth connecting segment 425 has one end opposite to the fourth connecting segment 424 and connected to the second grounding section 32. The second connecting segment 422 and the fourth connecting segment 424 extend in the X-axis direction, and the first connecting segment 421, the third connecting segment 423 and the fifth connecting segment 425 extend in the Y-axis direction. Projections of the first connecting segment 421, the second connecting segment 422, the fourth connecting segment 424, and the fifth connecting segment 425 onto the first surface 11 are in the region 81 between the first radiator arm 21 and the first grounding section 31.

Referring to FIG. 1, in this embodiment, a projection of the coupling conductor 6 onto the first surface 11 overlaps completely with the first radiator arm 21 and the second radiator arm 22, but it may overlap partially in other embodiment of this invention. The first grounding section 31 overlaps completely with a projection of the second grounding section 32 onto the first surface 11, but it may overlap partially in other embodiment of this invention. The first connecting conductor 41 is required to have at least a portion thereof overlap with a projection of the second connecting conductor 42 onto the first surface 11. For example, in this embodiment, each of the first connecting section 411, the second connecting section 412 and the third connecting section 413 overlaps with a respective one of projections of the third connecting segment 423, the fourth connecting segment 424 and the fifth connecting segment 425 onto the first surface 11. Moreover, the first grounding section 31 is connected to the second grounding section 32 via an external conductor wire (not shown) for ensuring that the first grounding section 31 and the second grounding section 32 have the same electrical potential.

Figure 4:
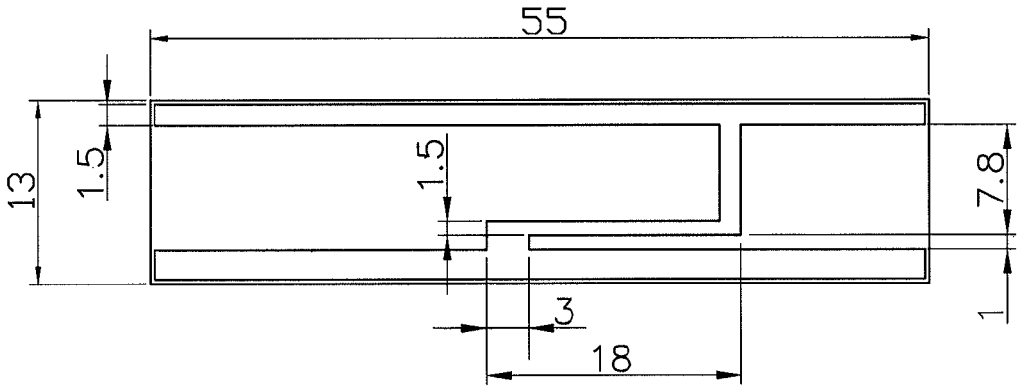
FIG. 4 is a schematic view illustrating actual dimensions of the first conductor circuit of the first embodiment.
Figure 5:
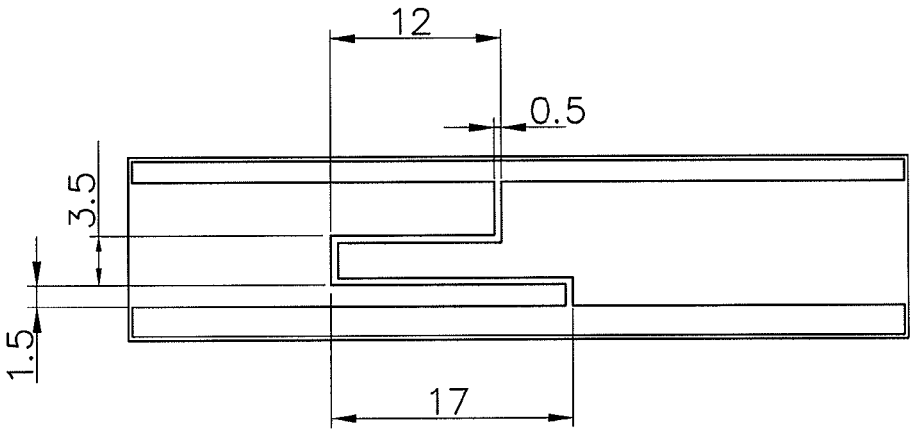
FIG. 5 is a schematic view illustrating actual dimensions of the second conductor circuit of the first embodiment.

Referring to FIG. 4 and FIG. 5, actual dimensions of the broadband antenna 100 of this embodiment are illustrated. FIG. 4 is a view of the first surface 11 of the substrate 1, and FIG. 5 is a view of the second surface 12 of the substrate 1. Units of this embodiment in FIG. 4 and FIG. 5 are in millimeters (mm). Dimensions of the first radiator arm 21, the second radiator arm 22, the coupling conductor 6, the first grounding section 31, the second grounding section 32, the first connecting conductor 41, and the second connecting conductor 42 are not limited to those illustrated in this embodiment.

Figure 6:
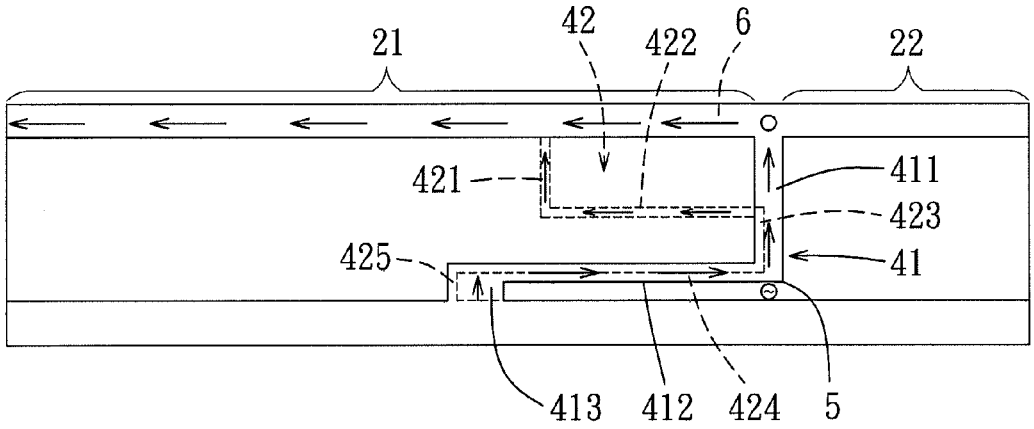
FIG. 6 illustrates a transmission direction of radio frequency signals in the first conductor circuit of the first embodiment.
Figure 7:
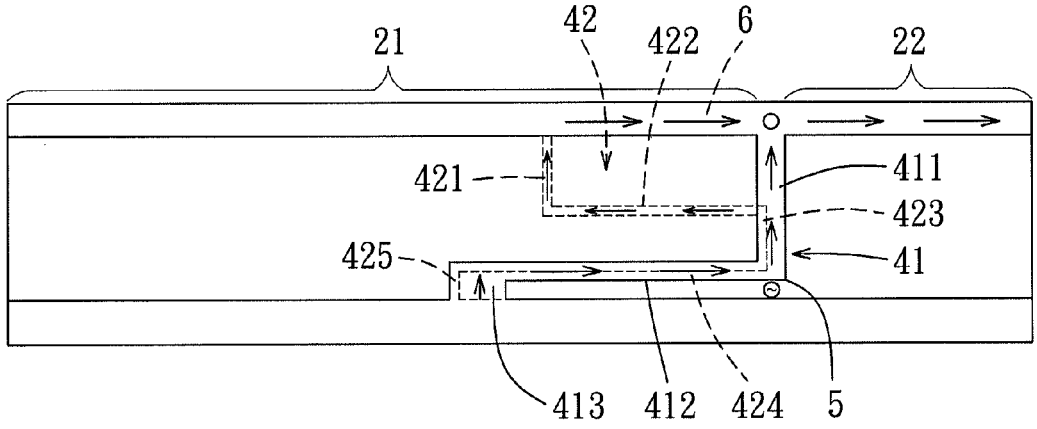
FIG. 7 illustrates a transmission direction of radio frequency signals in the second conductor circuit of the first embodiment.
Figure 8:
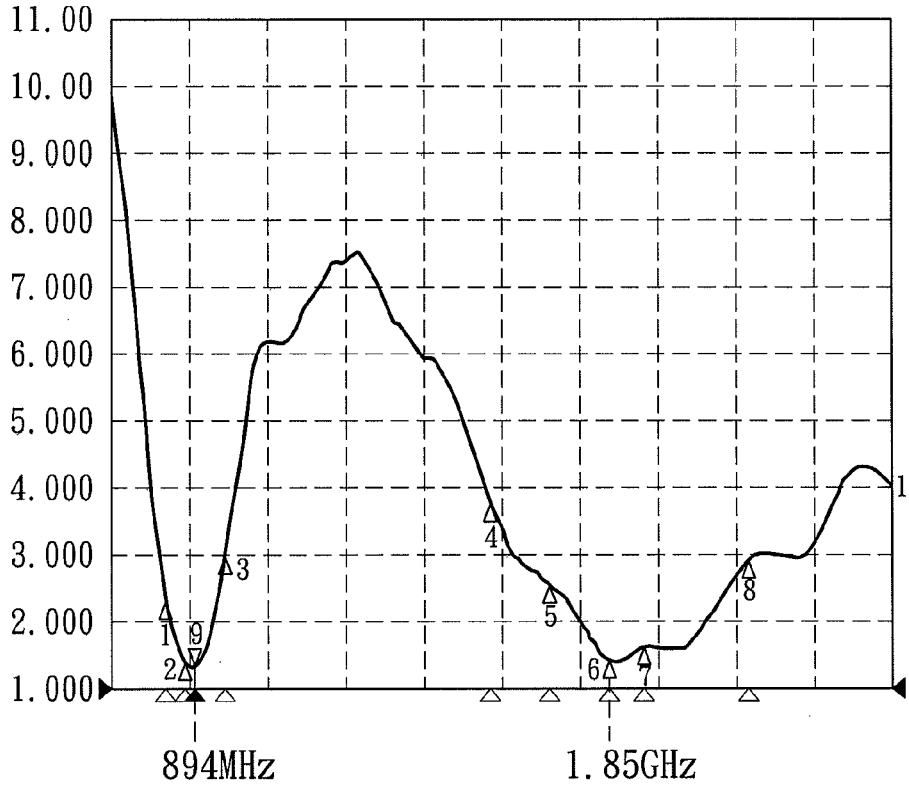
FIG. 8 is a Voltage Standing Wave Ratio plot (VSWR) of the broadband antenna of the first preferred embodiment.

Referring to FIG. 6, FIG. 7 and FIG. 8, when the broadband antenna 100 is fed with radio frequency signals from the feed-in point 5, the radio frequency signals will be transmitted from the feed-in point 5 toward directions of the first radiator arm 21 and the second radiator arm 22 (as shown by the arrows in FIG. 6 and FIG. 7), and will resonate in a respective one of frequency bands having center frequencies of 894 MHZ (low frequency) and 1.85 GHz (high frequency) (as evident from the VSWR plot in FIG. 8) for achieving an effect of operating in dual bands. Specifically, when the radio frequency signals are transmitted in the first connecting section 411, the radio frequency signals will be coupled to the third connecting segment 423 on the second surface 12 of the substrate 1, and will be transmitted along the second connecting segment 422 and the first connecting segment 421 to the coupling conductor 6 so that current directions in the first connecting conductor 41 and the second connecting conductor 42 will be the same. Thus, radiation patterns of this embodiment will have an additive effect for increasing the transmission efficiency and the bandwidth of the broadband antenna 100.

Furthermore, referring to FIG. 1, the junction of the first radiator arm 21 and the second radiator arm 22 on the substrate 1 of this embodiment further includes a conductive via 7 formed through the first surface 11 and the second surface 12 so as to connect the coupling conductor 6 to the first connecting conductor 41, the first radiator arm 21, and the second radiator arm 22 for increasing transmission efficiency of the broadband antenna 100. In another embodiment, the conductive via 7 is disposed at one of the first radiator arm 21, the second radiator arm 22, and the first connecting conductor 41. Furthermore, the number of the conductive via 7 is not limited to one, and a plurality of conductive vias 7 may be disposed at the first radiator arm 21 and the second radiator arm 22 (any adjacent two of the conductive vias 7 need to be spaced apart by a certain distance) for achieving better transmission efficiency. Moreover, another conductive via 7 may be disposed at the first grounding section 31 for connecting the first grounding section 31 to the second grounding section 32 so as to omit requirement of the external conductor wire.

Figure 9:
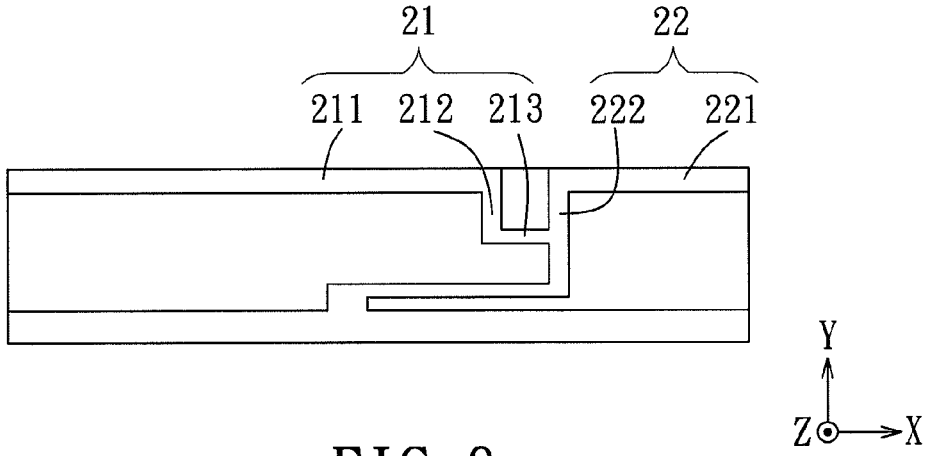
FIG. 9 illustrates another connecting manner between a first radiator arm and a second radiator arm of the first preferred embodiment.

Furthermore, the first radiator arm 21 and the second radiator arm 22 may not be completely parallel with the first grounding section 31. Referring to FIG. 9, the first radiator arm 21 includes a first radiator part 211, a second radiator part 212 and a third radiator part 213 interconnected in series, and the second radiator arm 22 includes a first radiator portion 221 and a second radiator portion 222 connected to each other. The third radiator part 213 has an end opposite to the second radiator part 212 and connected to one end of the second radiator portion 222 opposite to the first radiator portion 221, such that the junction of the first radiator arm 21 and the second radiator arm 22 is not at the long side of the substrate 1. The effects of the first embodiment mentioned above may likewise be achieved in this way.

Figure 10:
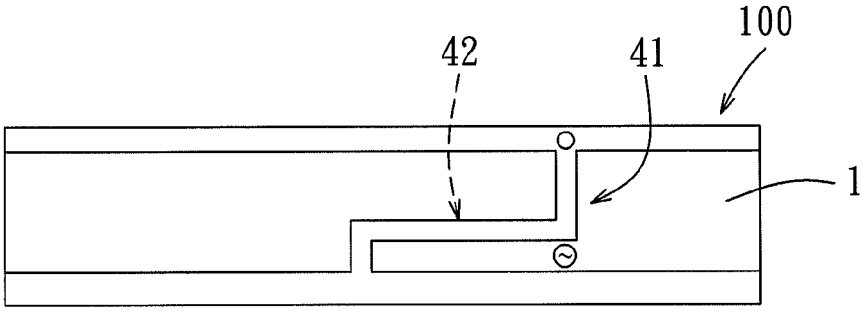
FIG. 10 illustrates a second preferred embodiment of the broadband antenna of the present invention.
Figure 11:
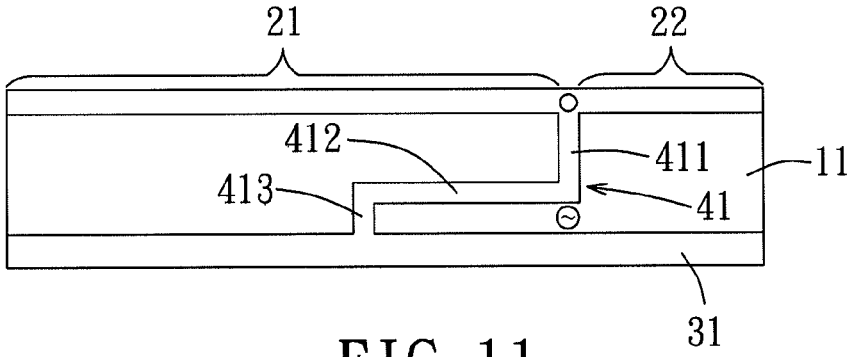
FIG. 11 illustrates a first conductor circuit on a first surface of a substrate of the second preferred embodiment.
Figure 12:
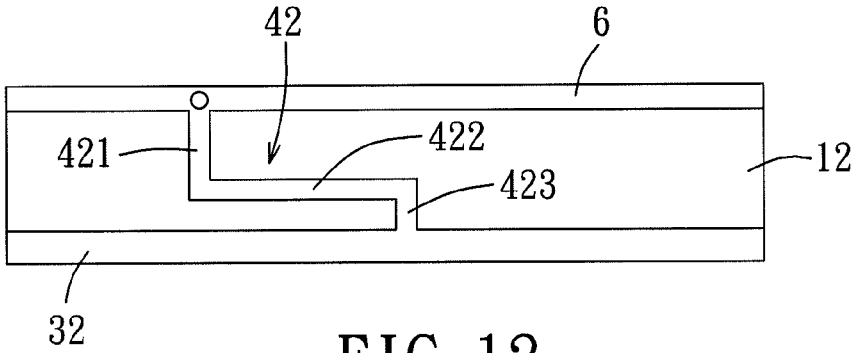
FIG. 12 illustrates a second conductor circuit on a second surface of the substrate of the second preferred embodiment.
Figure 13:
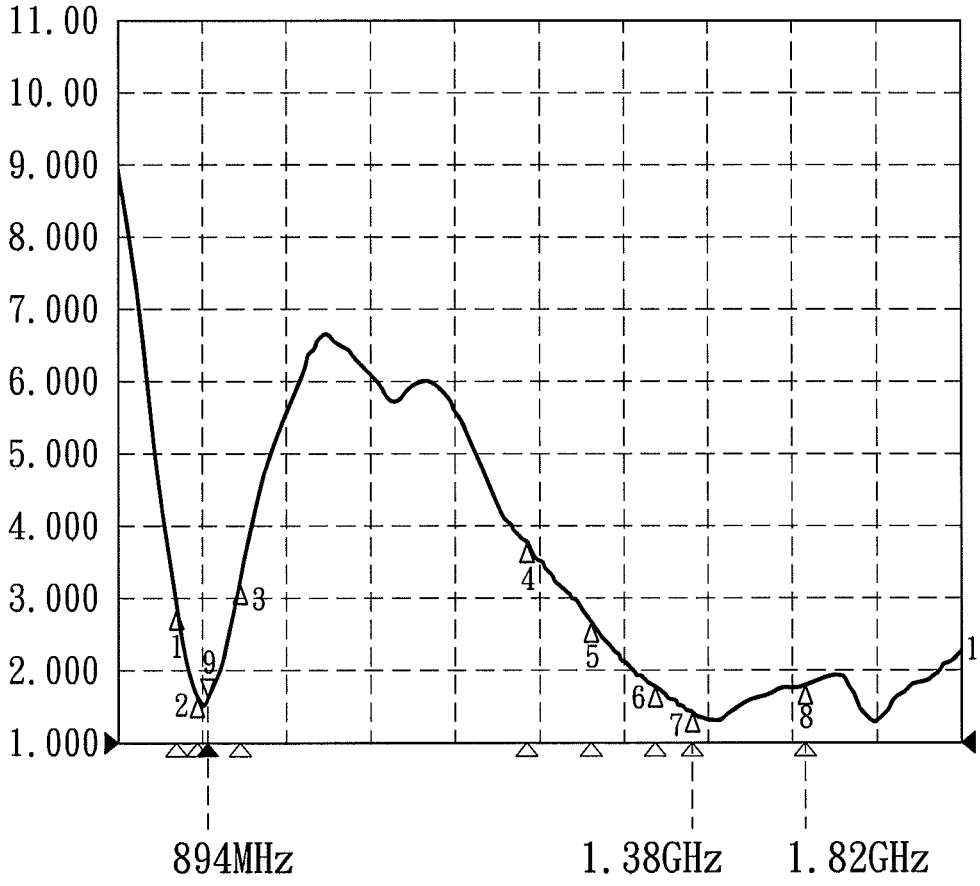
FIG. 13 is a VSWR plot of the broadband antenna of the second preferred embodiment.

Referring to FIG. 10, FIG. 11 and FIG. 12, a second preferred embodiment of the broadband antenna 100 of the present invention is illustrated, which is substantially similar to the first embodiment. The differences reside in that the second connecting conductor 42 includes a first connecting segment 421, a second connecting segment 422, and a third connecting segment 423 interconnected in series (best shown in FIG. 12). The structures and positions of the first connecting segment 421, the second connecting segment 422, and the third connecting segment 423 correspond respectively to projections of the first connecting section 411, the second connecting section 412, and the third connecting section 413 onto the second surface 12 so that the first connecting conductor 41 overlaps completely with a projection of the second connecting conductor 42 onto the first surface 11 (see FIG. 10). In this way, the radiation patterns may achieve an additive effect for increasing the bandwidth and transmission efficiency of the broadband antenna 100. FIG. 13 shows a VSWR plot of the broadband antenna 100 of this embodiment.

Figure 14:
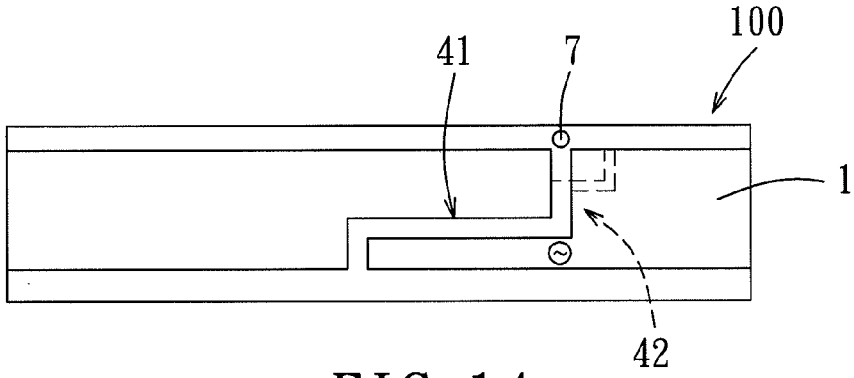
FIG. 14 illustrates a third preferred embodiment of the broadband antenna of the present invention.
Figure 15:
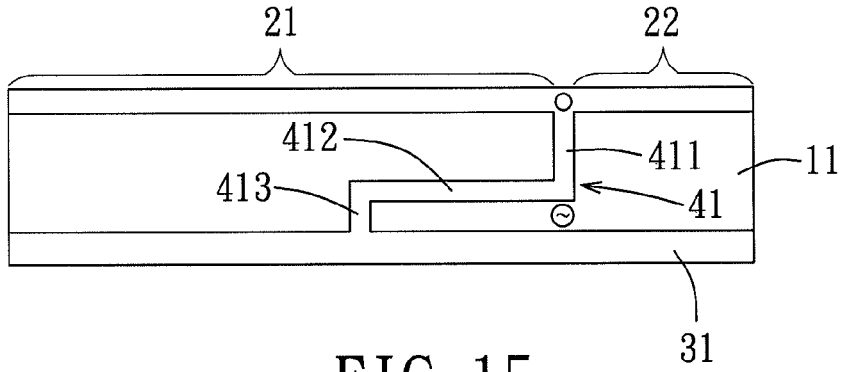
FIG. 15 illustrates a first conductor circuit on a first surface of a substrate of the third preferred embodiment.
Figure 16:
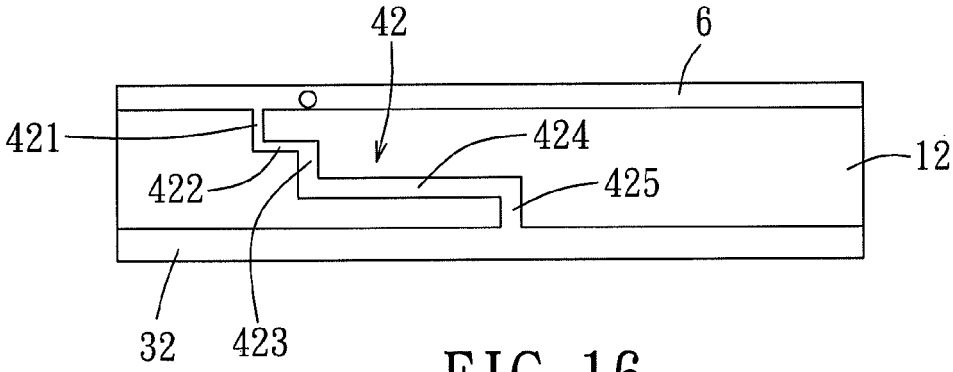
FIG. 16 illustrates a second conductor circuit on a second surface of the substrate of the third preferred embodiment.
Figure 17:
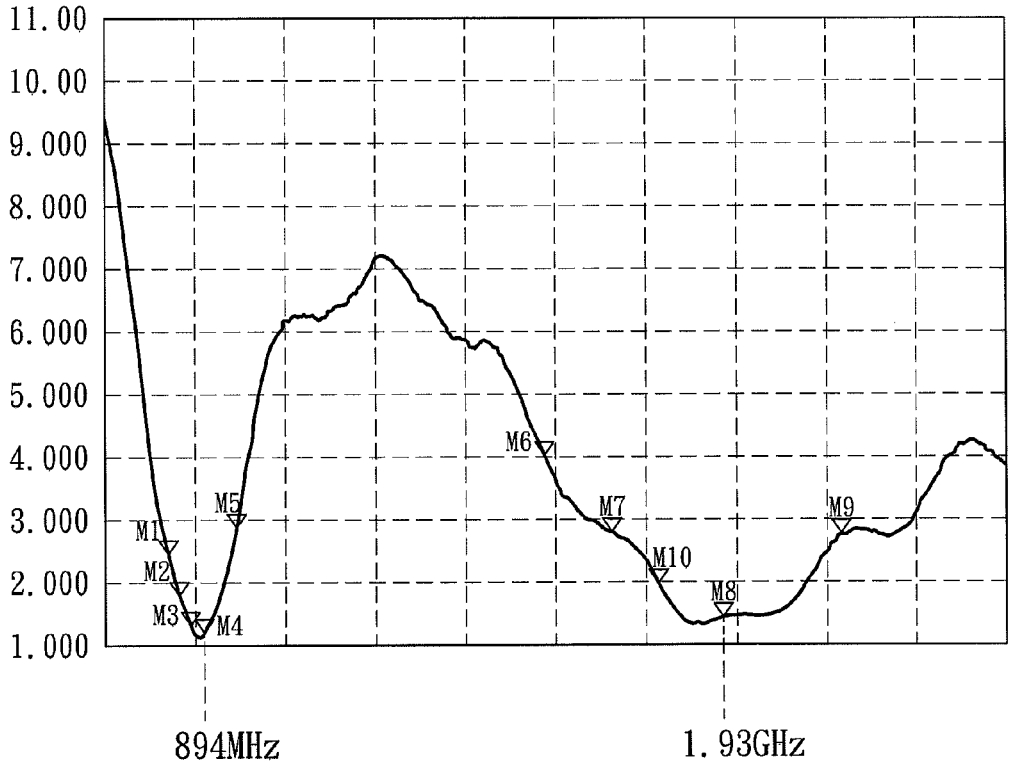
FIG. 17 is a VSWR plot of the broadband antenna of the third preferred embodiment.

Referring to FIG. 14, FIG. 15 and FIG. 16, a third preferred embodiment of the broadband antenna 100 of the present invention is illustrated, which is substantially similar to the first embodiment. The differences reside in that the projections of the first connecting segment 421 and the second connecting segment 422 onto the first surface 11 are in the region between the second radiator arm 22 and the first grounding section 31, and the projections of the fourth connecting segment 424 and the fifth connecting segment 425 onto the first surface 11 are in a region between the first radiator arm 21 and the first grounding section 31. Referring to FIG. 17, in this way, the radiation patterns may achieve an additive effect, and the center frequency of the high frequency band may be raised to 1.93 GHz.

Figure 18:
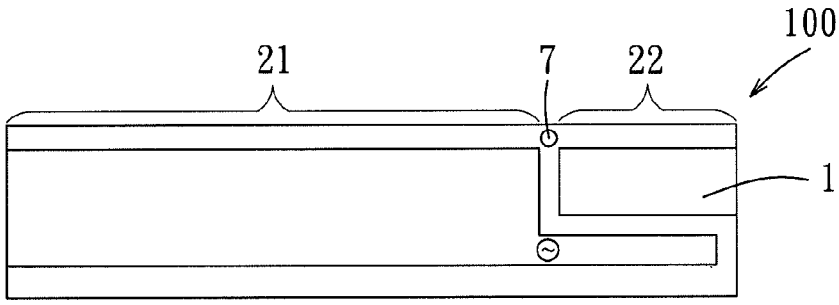
FIG. 18 illustrates a fourth preferred embodiment of the broadband antenna of the present invention.
Figure 19:
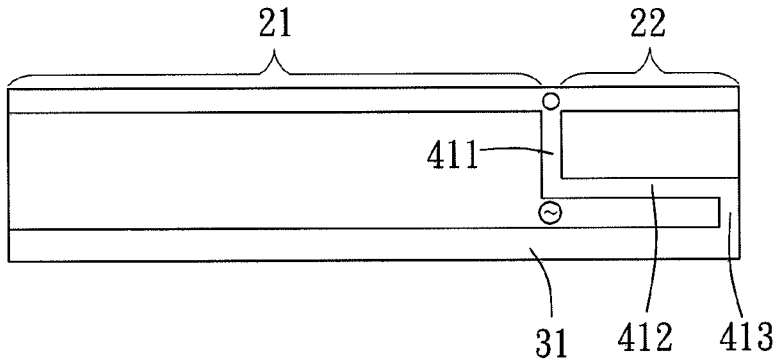
FIG. 19 illustrates a first conductor circuit on a first surface of a substrate of the fourth preferred embodiment.
Figure 20:
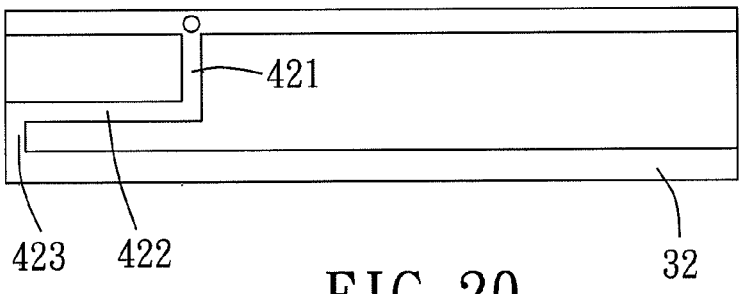
FIG. 20 illustrates a second conductor circuit on a second surface of the substrate of the fourth preferred embodiment.
Figure 21:
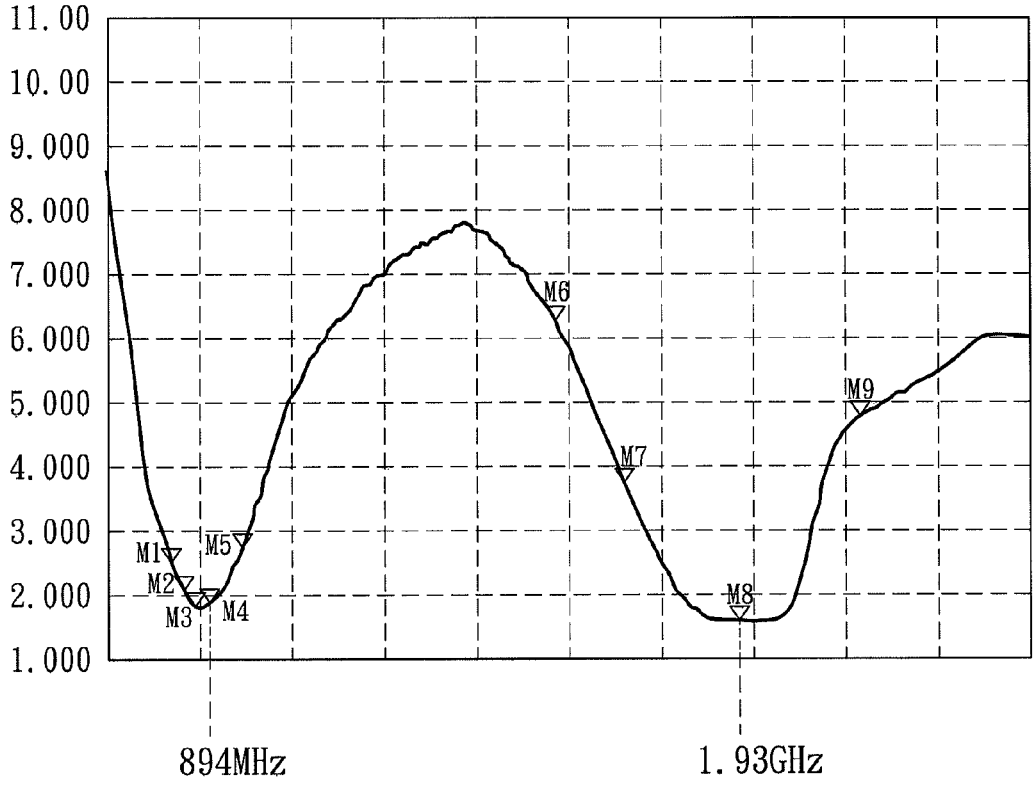
FIG. 21 is a VSWR plot of the broadband antenna of the fourth preferred embodiment.

Referring to FIG. 18, FIG. 19 and FIG. 20, a fourth preferred embodiment of the broadband antenna 100 of the present invention is illustrated. In this embodiment, the first connecting section 411 and the second connecting section 412 of the first connecting conductor 41 are in the region between the second radiator arm 22 and the first grounding section 31, and the third connecting section 413 is disposed along a short side of the first surface 11. The second connecting conductor 42 includes a first connecting segment 421, a second connecting segment 422 and a third connecting segment 423 interconnected in series (see FIG. 20). The structures and positions of the first connecting segment 421, the second connecting segment 422, and the third connecting segment 423 correspond respectively to projections of the first connecting section 411, the second connecting section 412, and the third connecting section 413 onto the second surface 12 so that the first connecting conductor 41 overlaps completely with a projection of the second connecting conductor 42 onto the first surface 11. In this way, transmission directions of the radio frequency signals in the first connecting conductor 41 and the second connecting conductor 42 are the same so that the radiation patterns may achieve an additive effect for increasing the bandwidth and the transmission efficiency of the broadband antenna 100. FIG. 21 shows a VSWR plot of the broadband antenna 100 of this embodiment.

Figure 22:
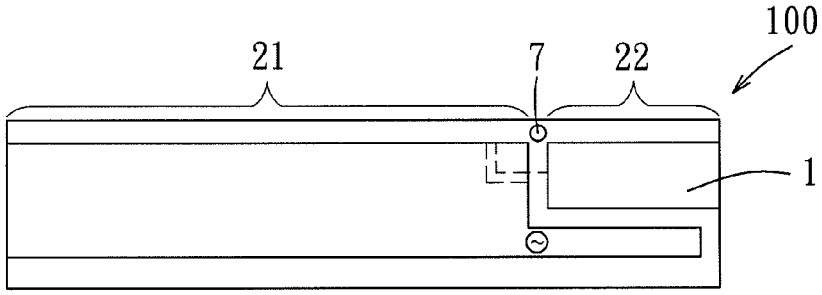
FIG. 22 illustrates a fifth preferred embodiment of the broadband antenna of the present invention.
Figure 23:
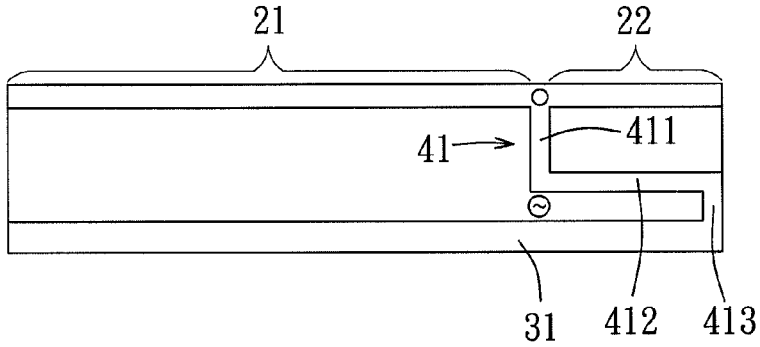
FIG. 23 illustrates a first conductor circuit on a first surface of a substrate of the fifth preferred embodiment.
Figure 24:
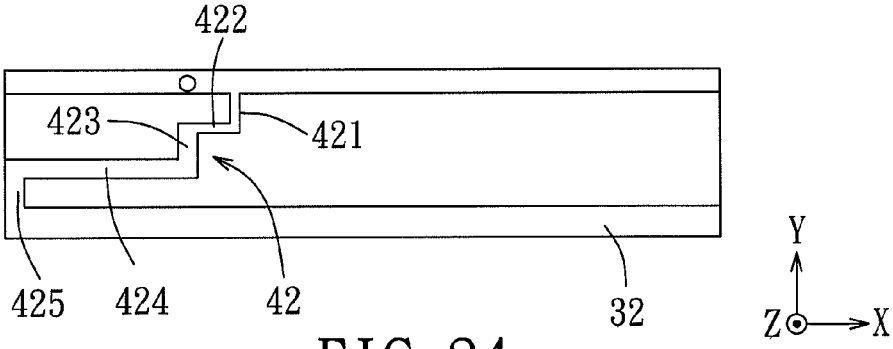
FIG. 24 illustrates a second conductor circuit on a second surface of the substrate of the fifth preferred embodiment.
Figure 25:
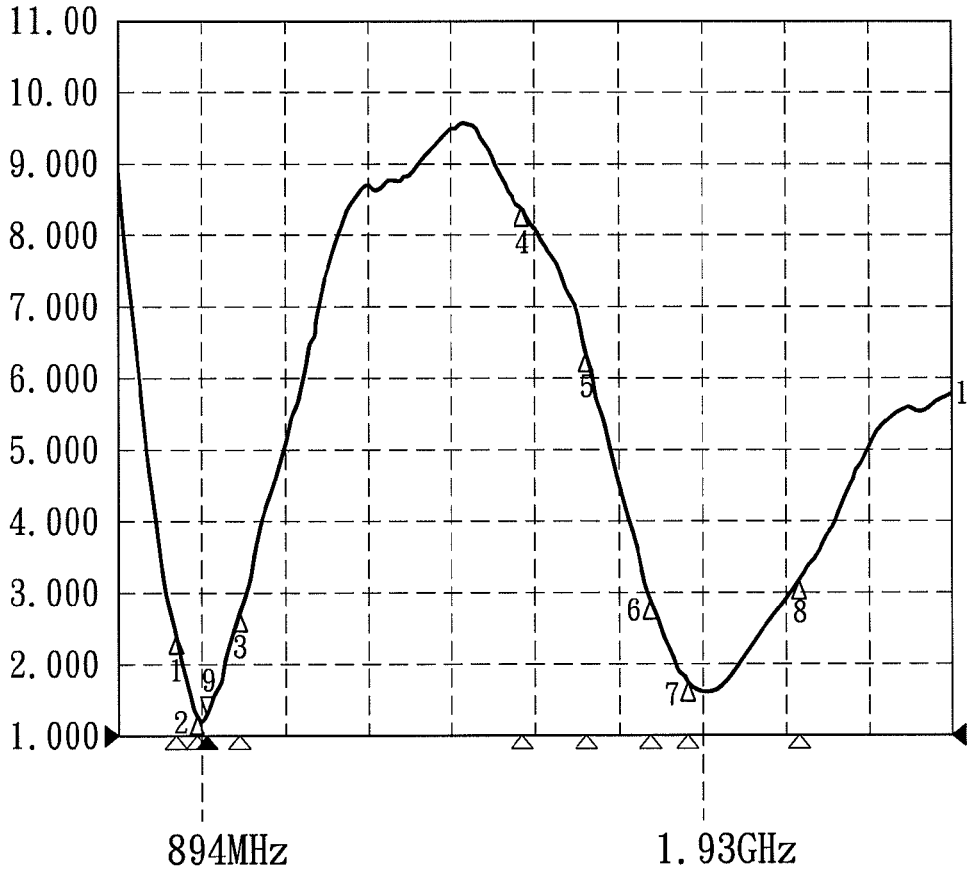
FIG. 25 is a VSWR plot of the broadband antenna of the fifth preferred embodiment.

Referring to FIG. 22, FIG. 23 and FIG. 24, a fifth preferred embodiment of the broadband antenna 100 of the present invention is illustrated, which is substantially similar to the fourth embodiment. The differences reside in that the second connecting conductor 42 includes a first connecting segment 421, a second connecting segment 422, a third connecting segment 423, a fourth connecting segment 424 and a fifth connecting segment 425 interconnected in series (see FIG. 24). The second connecting segment 422 and the fourth connecting segment 424 extend in the X-axis direction, and the first connecting segment 421, the third connecting segment 423 and the fifth connecting segment 425 extend in the Y-axis direction. Moreover, the first connecting segment 421 and the second connecting segment 422 are in the region between the first radiator arm 21 and the first grounding section 31, and the fourth connecting segment 424 and the fifth connecting segment 425 are in the region between the second radiator arm 22 and the first grounding section 31. In this way, transmission directions of the radio frequency signals in the first connecting conductor 41 and the second connecting conductor 42 are the same for increasing the bandwidth and the transmission efficiency of the broadband antenna 100. FIG. 25 shows a VSWR plot of the broadband antenna 100 of this embodiment.

In summary, the broadband antenna 100 of the present invention may achieve an additive effect of the radiation patterns for increasing the bandwidth and the transmission efficiency of the broadband antenna 100 in a limited space by disposing the first grounding section 31 and the second grounding section 32 respectively on the first surface 11 and the second surface 12 of the substrate 1, and by configuring at least a portion of the first connecting conductor 41 to overlap with the projection of the second connecting conductor 42 onto the first surface 11 so that the current directions in the first connecting conductor 41 and the second connecting conductor 42 are the same.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A broadband antenna comprising:

a substrate having a first surface, and a second surface opposite to said first surface;

a first radiator arm disposed on said first surface;

a second radiator arm disposed on said first surface, and connected to one end of said first radiator arm;

a first grounding section disposed on said first surface;

a first connecting conductor disposed on said first surface, said first connecting conductor having one end connected to a junction of said first radiator arm and said second radiator arm, and having another end connected to said first grounding section, said first connecting conductor having a feed-in point disposed thereon, said first connecting conductor including a first connecting section, a second connecting section and a third connecting section which are connected in sequence, said first and third connecting sections extending in one direction perpendicular to another direction in which said second connecting section extends;

a second grounding section disposed on said second surface;

a coupling conductor disposed on said second surface, at least a portion of said coupling conductor overlapping with a projection of said first and second radiator arms onto said second surface; and a second connecting conductor disposed on said second surface, having one end connected to said second grounding section, and having another end connected to said coupling conductor, at least a portion of said second connecting conductor overlapping with a projection of said first connecting conductor onto said second surface, said second connecting conductor including a first connecting segment, a second connecting segment, a third connecting segment, a fourth connecting segment and a fifth connecting segment which are connected in sequence, said second and fourth connecting segments extending in one direction perpendicular to another direction in which said first, third and fifth connecting segments extend; and wherein said substrate further includes a conductive via formed through said first surface and said second surface for connecting said coupling conductor to said first connecting conductor, said first radiator arm, and said second radiator arm at the junction of said first radiator arm and said second radiator arm.

2. The broadband antenna as claimed in claim 1, wherein said first radiator arm, said second radiator arm and said first grounding section are substantially parallel with each other, said first grounding section being disposed at one side of said first surface, said first radiator arm and said second radiator arm being disposed at another side of said first surface opposite to said first grounding section.

3. The broadband antenna as claimed in claim 1, wherein said first grounding section is disposed at one side of said first surface, said second grounding section is disposed along one side of said second surface that corresponds to said one side of said first surface, and said first grounding section overlaps with a projection of said second grounding section onto said first surface.

4. The broadband antenna as claimed in claim 3, wherein said substrate further includes a connecting via formed through said first surface and said second surface for connecting said first grounding section to said second grounding section.

5. The broadband antenna as claimed in claim 1, wherein said first radiator arm and said second radiator arm are disposed at one side of said first surface, and said coupling conductor is disposed along one side of said second surface that corresponds to said one side of said first surface.

* * * * *